United States Patent [19]

Ash

[11] 4,246,883

[45] Jan. 27, 1981

[54] ARCHERY BOW WITH BOW LIMB COCKING MECHANISM

[76] Inventor: Lee A. Ash, Rte. 2, Box 142, Weatherford, Okla. 73096

[21] Appl. No.: 52,025

[22] Filed: Jun. 25, 1979

[51] Int. Cl.[3] ..... F41B 5/00

[52] U.S. Cl. ..... 124/24 R; 124/86; 81/3 R

[58] Field of Search ..... 124/23 R, 24 R, 88, 124/90, 35 A

[56] References Cited

U.S. PATENT DOCUMENTS

| | | | |
|---|---|---|---|
| 2,736,309 | 2/1956 | Hoffman . | |
| 3,552,373 | 1/1971 | Van Hecke | 124/24 R |
| 3,595,213 | 7/1971 | Storer . | |
| 3,674,001 | 7/1972 | Hitt | 124/24 R |
| 3,826,239 | 7/1974 | Palma . | |
| 3,841,295 | 10/1974 | Hunter . | |
| 3,851,638 | 12/1974 | Alexander | 124/24 R |
| 3,981,290 | 9/1976 | Islas . | |
| 3,987,777 | 10/1976 | Darlington . | |
| 3,993,039 | 11/1976 | Groves et al. . | |
| 4,078,537 | 3/1978 | Carella . | |

*Primary Examiner*—Richard C. Pinkham
*Assistant Examiner*—William R. Browne
*Attorney, Agent, or Firm*—Donald A. Kettlestrings

[57] ABSTRACT

An archery bow having a handle, an inner pair of bow limbs projecting outwardly from opposite ends of the handle and an outer pair of bow limbs projecting outwardly from opposite ends of the handle. A cable is connected to ends of the inner bow limbs and through the handle via a pulley system. A cocking mechanism is attached to an end of the cable and is mounted at an end of one of the inner bow limbs for enabling the archer to increase tension on the cable whereby the inner bow limbs are stressed and placed in a cocked position. A release mechanism is mounted at an end of one of the outer bow limbs. When the archer draws and releases the bow string extending between the outer limbs, the release mechanism triggers the cocking mechanism to release the inner bow limbs which act in cooperation with the outer bow limbs whereby increased thrust is imparted to the arrow.

19 Claims, 9 Drawing Figures

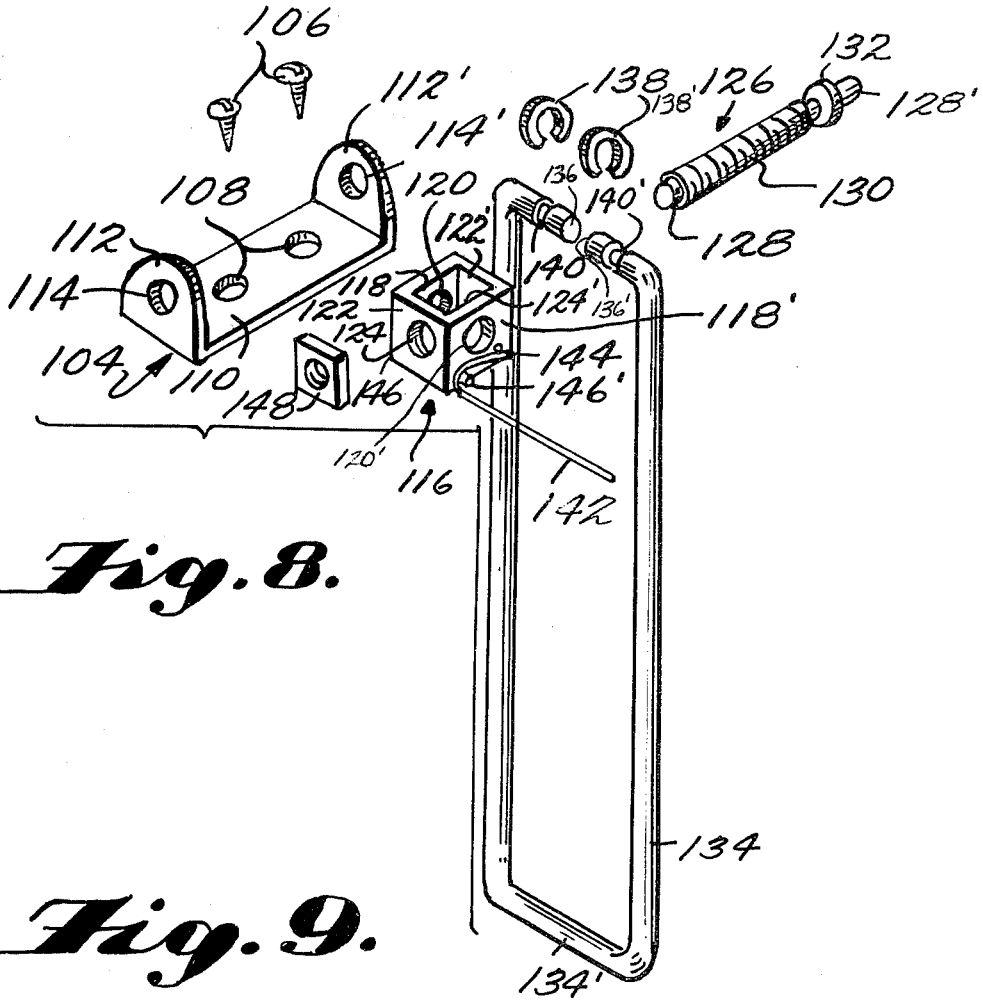
Fig. 8.
Fig. 9.
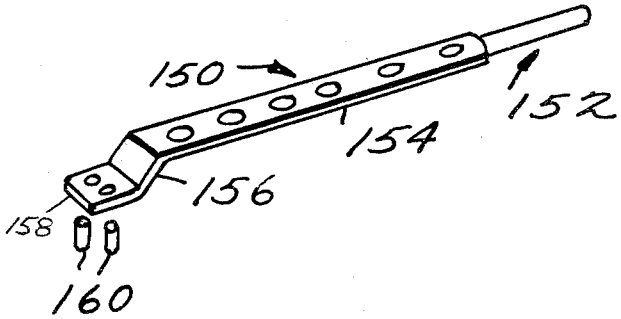
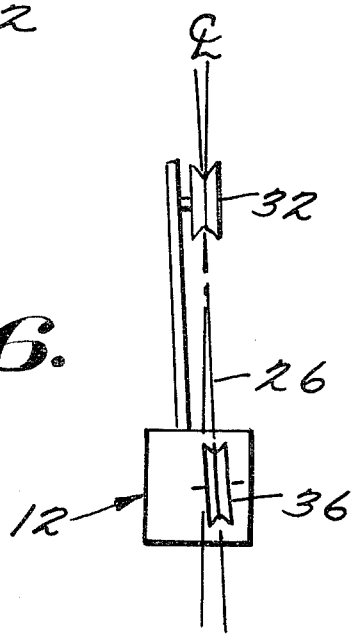
Fig. 6.

94
88
90
92
82
80
84
86
98
96
91
48
50
50'
52
52'
46
53
53'
18
15
14
69
68
60
59
54
58
72
56
100'
60'
58'
66
70
78
76
74
62
64
57
67
26'
26

ARCHERY BOW WITH BOW LIMB COCKING MECHANISM

This invention relates to an improved archery bow and more particularly to a bow having increased power without requiring increased effort by the archer.

Every archer would like to shoot a very powerful bow in order to make the arrow fly faster, flatter and with greater penetration. When using conventional archery bows, however, the force imparted to the arrow is limited by the archer's strength, and most hunters are limited to use of bows from 45 to 55 pounds in range. The present invention overcomes this difficulty by providing a bow with an additional pair of bow limbs that act in concert with the regular bow limbs to provide a more powerful bow which imparts a greater thrust to the arrow.

It is an object of the present invention to provide an improved archery bow providing for increased power without requiring increased effort by the archer.

Another object is to provide an improved archery bow wherein the power imparted to the arrow by the bow can be adjusted while the effort required by the archer remains constant.

A further object of the invention is the provision of an improved archery bow wherein energy is stored in two separate systems of limbs in such a manner that the collective energy stored is greater than an archer would be able to store by use of a conventional bow.

Still another object is to provide an improved archery bow having two separate systems of limbs and wherein the force imparted to the arrow is increased by releasing both systems simultaneously to impart a greater amount of energy to the arrow.

Yet another object of the present invention is the provision of an improved archery bow having only a single bow string extending between the tips of the outer bow limbs, thus eliminating the obstruction of pulley strings between the nocking point and the bow handle.

A still further object is to provide an improved bow which enables the archer to draw the bow with a minimum of effort throughout the full draw.

Another object of the present invention is to provide an improved archery bow which prevents the user from over-drawing when the bow is at full draw.

Yet another object is to provide an improved archery bow which enables the user to adjust the bow and the force imparted to the arrow while still requiring a minimum constant effort by the user.

A further object is to provide an improved archery bow wherein the archer can adjust the bow so that both sets of bow limbs are simultaneously released from stressed conditions at the time the arrow is shot to provide maximum acceleration and force to the arrow, and whereby release of the inner set of bow limbs is delayed to provide a more gradual acceleration of the arrow.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides for an improved archery bow having a bow handle, a first or inner pair of bow limbs projecting outwardly from opposite ends of the handle to present a first pair of spaced free limb ends, a second or outer pair of bow limbs projecting outwardly from opposite ends of the handle to present a second pair of spaced free limb ends, means in operative relationship with the handle for supporting and guiding a cable in predetermined relationship with the handle, a cable attached to an end of one of the inner pair of bow limbs and positioned in supported and guided relationship with respect to the supporting means, means attached to another end of one of the inner bow limbs and to the cable for enabling tension on the cable and stress on the inner pair of bow limbs to be increased or decreased, and means attached to an end of one of the outer bow limbs in operative relationship with the tension adjusting means for selectively mechanically interacting with the tension adjusting means to result in reduction of the tension in the cable and in the stress in the inner pair of limbs.

In accordance with the invention, the bow handle defines a hollow opening and the supporting and guiding means support and guide the cable through the handle opening. The bow further defines an imaginary longitudinal center line plane, and the cable preferably passes through at least a portion of the handle opening at locations offset from the imaginary center line plane.

It is to be understood that both the foregoing general description and the following detailed description are exemplary and explanatory, but are not restrictive of the invention.

The accompanying drawings, which are incorporated in and constitute a part of this specification, illustrate an example of a preferred embodiment of the invention and, together with the description, serve to explain the principles of the invention.

FIG. 6 is a horizontal section view of the bow taken along line 6—6 in FIG. 3 and looking in the direction of the arrows.

FIG. 8 is an exploded perspective view of the release mechanism of the bow; and FIG. 9 is a perspective view of the tool used with the bow to move the cocking mechanism into cocked position.

Figure 1:
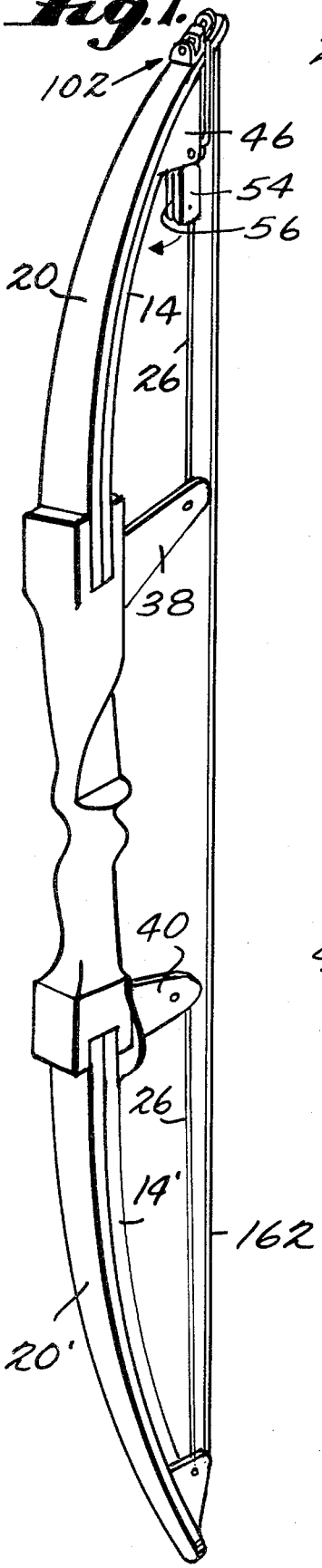
FIG. 1 is a perspective view of the archery bow.
Figure 2:
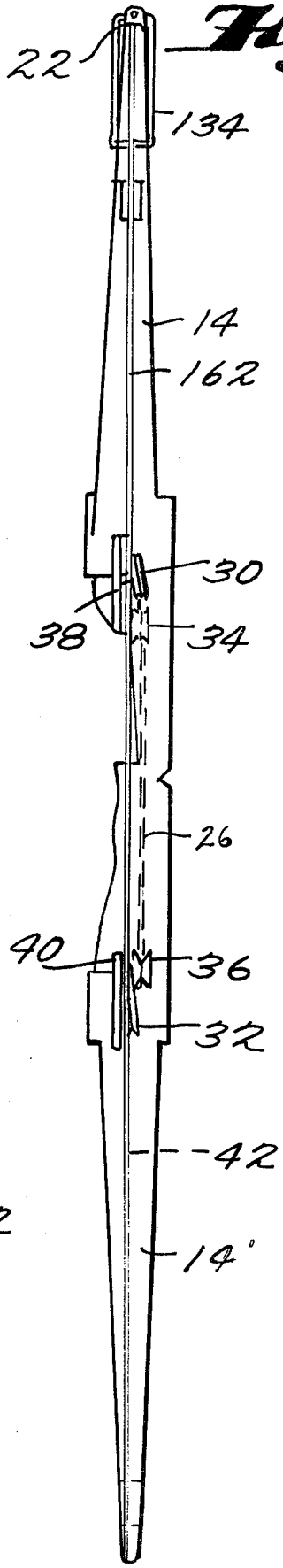
FIG. 2 is an elevation view of the bow, partially cut away to show the arrangement of pulleys in the handle.
Figure 3:
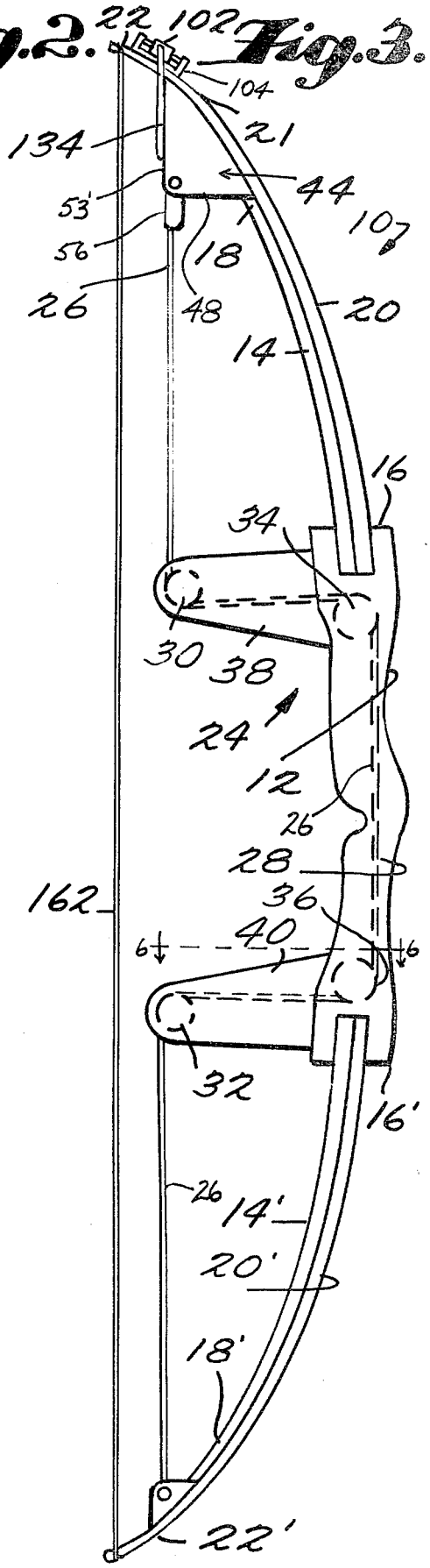
FIG. 3 is a side elevation view of the bow.

With reference now to the drawings, wherein like reference characters designate like or corresponding parts throughout the several views, there is shown an improved archery bow 10 having a bow handle 12. A first or inner pair of bow limbs 14, 14' project outwardly from opposite ends 16, 16' of the bow handle 12 to present a first pair of spaced free limb ends 18, 18'. A second or outer pair of bow limbs 20,20' project outwardly from opposite ends 16, 16' of bow handle 12 to present a second pair of spaced free limb ends 22, 22'.

First means 24 are provided in operative relationship with handle 12 for supporting and guiding a cable 26 through a hollow opening 28 in handle 12. Cable 26 is attached between ends 18, 18' of inner bow limbs 14, 14', and cable 26 is supported and guided through handle 12 by means of a plurality of pulleys 30,32,34 and 36.

More specifically, first means 24 include first and second brace members 38, 40 projecting from bow handle 12. First pulley 30 is mounted on first brace member 38 and second pulley 32 is mounted on second brace member 40. Third pulley 34 and fourth pulley 36 are positioned within and mounted on handle 12, and each of the pulleys receives and supports cable 26 as the cable passes through handle 12.

Bow 10 preferably defines an imaginary longitudinal center line plane 42 passing substantially through the centerline of the bow and a strung bow string extending between a pair of spaced free limb ends, and pulleys 30,32,34 and 36 are canted to enable cable 26 to pass through handle opening 28 at locations offset from imaginary center line plane 42. This is best illustrated in FIG. 6. It is, however, important the pulleys 30, 32 be positioned on braces 38, 40 to enable cable 26 to be positioned within imaginary center line plane 42 as the cable extends between pulleys 30,32 and ends 18, 18' of inner bow limbs 14, 14'. This will prevent any twisting of the inner bow limbs.

Second means 44 are attached to end 18 of inner bow limb 14, and second means 44 are attached to cable 26 for enabling tension on the cable and stress on inner limbs 14,14' to be increased or decreased. More specifically, second means 44 include first and second support members 46, 48 attached to inner bow limb 14 and adjacent to 18 thereof. Each of support members 46, 48 defines a first aperture 50, 50' a second aperture 52, 52' and a first edge surface 53, 53'.

First and second plate members 54, 56 are provided, and each plate member defines a third aperture 58, 58' respectively, and a fourth aperture 60, 60' respectively. Plate members 54, 56 further include means 62 for holding one end 26' of cable 26, and plate members 54,56 each define a lip 64, coincident with imaginary center line 100 of plate members 54, 56, and a recessed groove 66 of a sufficient dimension for receiving cable 26 within the groove. An axle 68 extends through and in rotatively movable relationship with third apertures, 58, 58', and axle 68 further extends through and in rotatively movable relationship with first apertures 50, 50' of support members 46, 48. Suitable keepers (not shown) may be used to engage grooves 69 of axle 68 so that the axle will not become disengaged from apertures 58, 58'.

Although there are many ways to attach end 26' of cable 26 to plate members 54, 56, the best mode presently known provides for a recessed cavity 70 within each of plate members 54, 56 and wherein each cavity 70 is in communication with each respective groove 66 via slots 67 to enable the cable to extend from cavities 70 and to lie within grooves 66. Holding means 62 preferably also include a disc 72 defining an eccentrically positioned aperture 74, and a spindle 76 extending through aperture 74 and positioned in fixed relationship with plate members 54, 56. Spindle 76 is preferably seated within depression 78 in plate member 56 and within a similar depression (not shown) within plate member 54. Eccentric disc 72 provides a positive anchoring point for end 26' of the cable, and the end of the cable is attached to disc 72.

A trigger 80 defining a fifth aperture 82 is provided and the trigger further defines an arm member 84 and a catch surface 86 for selectively engaging lips 64 of plate members 54, 56. A pin 88 extends through and in rotatively movable relationship with aperture 82, and pin 88 further extends through and in rotatively movable relationship with apertures 52, 52' of support members 46,48. Suitable keepers 91 may be used to engage grooves 90 of pin 88 so that the pin will not become disengaged from apertures 52, 52'.

A flat spring 92 projects from trigger 80 and presses against the inside surface 15 of inner bow limb 14, and arm member 84, as a result, is normally positioned to project beyond edge surfaces 53, 53' of support members 46, 48. Sleeves 94, 96 are positioned on pin 88 and between support members 46, 48 for maintaining trigger 80 in a substantially centered location on pin 88 and between support members 46, 48. Arm member 84 of the trigger also defines a lower surface 98 which normally projects beyond first edge surfaces 53, 53' of support members 46, 48.

Each of plate members 54, 56 is elongated in shape with a longer length dimension between ends 57, 59 than width dimension. Each of the plate members also defines an imaginary lengthwise center line 100, and the centers of each of apertures 58, 58' are positioned at a location offset from center lines 100, but equidistant from the lengthwise ends of each plate member 54, 56. The center of aperture 82 within trigger 80 and the centers of apertures 52, 52' within support numbers 46, 48 are positioned below lips 64 of plate members 54, 56 when the lips and catch surface 86 are in contacting relationship with each other, as will be later explained.

Third means or release mechanism 102 is attached to end 22 of outer bow limb 20 and in operative relationship with second means 44 for selectively mechanically interacting with second means 44(trigger 80) to result in reduction of tension in cable 26 and in a reduction in stress in inner bow limbs 14, 14' as will hereinafter be explained. More specifically, release mechanism 102 includes a mounting member 104 attached to an outer surface 21 of outer bow limb 20 and adjacent end 22 of the outer bow limb. Screws 106 or other conventional fastening means may be used to attach the mounting member to bow limb 20 by means of apertures 108 located within mounting member 104. Mounting member 104 further defines a planer base 110 and two flanges 112, 112' project upwardly from base 110 at substantially right angles thereto, and each of the flanges defines a non-threaded aperture 114, 114'.

An open-ended, cube-like member 116 includes two opposed wall sections 118, 118' each defining a non-threaded aperture 120, 120' therein. Cube-like member 116 also includes two additional opposed wall sections 122, 122' each defining a threaded aperture 124, 124' therein.

A screw 126 is provided and the screw defines first and second unthreaded ends 128, 128', a center threaded section 130, and an enlarged section 132 adjacent to end 128' for enabling manual turning of screw 126.

An elongated catch member 134 defines first and second ends 136, 136' and is positioned with ends 136, 136' rotatively positioned within unthreaded apertures 120, 120' of cube-like member 116. Lock washers or keepers 138, 138' are positioned within grooves 140, 140' of catch member 134 to hold the catch member in rotatable position within apertures 120, 120'.

Second spring means or spring 142 is attached to cube-like member 116 and in operative relationship with catch member 134 for contacting the catch member and for urging the catch member into continuously contacting relationship with edge surfaces 53, 53' of support members 46, 48. More specifically, cube-like member 116 defines additional apertures 144 in wall sections 118, 118', and spring supports 146, 146' project from wall sections 118, 118'. Spring 142 extends at least partially around and in supported relationship with supports 146, 146', and ends (not shown) of spring 142 are anchored by passing through apertures 144 and into the interior of cube-like member 116.

In accordance with this invention, means are provided in operative relationship with mounting member 104 and with catch member 134 for adjusting the position of the catch member with respect to the mounting member and with respect to trigger 80. This adjusting arrangement is provided for by threadedly engaging center threaded section 130 of screw 126 with threaded apertures 124, 124' of cube-like member 116. Unthreaded ends 128, 128' of screw 126 are simultaneously positioned within non-threaded apertures 114, 114' of flanges 112, 112'. A lock nut 148 is threaded onto center threaded section 130 of screw 126 and in contacting relationship with the exterior surface of wall section 122 for holding screw 126 in fixed position with respect to mounting member 104.

A tool 150, FIG. 9, is also provided for moving plate members 54, 56 into a cocked position whereby lips 64 engage catch surface 86. Tool 150 includes a tool handle 152, a body section 154 extending from tool handle 152, an angled member 156 extending from body section 154 and an end section 158 extending from angled member 156 and in substantially parallel relationship with respect to body section 154. At least one tooth member 160 projects at substantially a right angle from end section 158, and the tooth member or members is substantially circular in cross-section with an outside diamenter slightly less than the inside diameter of apertures 60, 60' of plate members 54,56.

In operation of the archery bow, tension on cable 26 and stress on inner bow limbs 14, 14' is first increased by cocking of second means or cocking mechanism 44. Bow handle 12 is grasped by the left hand of the archer while handle 152 of tool 150 is grasped in the archer's right hand. Offset end section 158 of tool 150 is then placed between support member 46 and plate member 54 in such a manner that tooth member or members 160 of tool 150 engage aperture or apertures 60, 60' in plate members 54,56. Movement of engaged tool 150 by the archer's right hand downwardly, then towards the archer's left hand, and finally upwardly and through a full 180° turn will rotate plate members 54, 56 about axle 68 until lips 64 are placed into contacting relationship with catch surface 86 of trigger 80. As plate members 54, 56 are rotated about axle 68, cable 26 will wind around plate members 54, 56 and will be positioned within grooves 66. This will result in increased tension on cable 26 and will cause increased stress on both inner bow limbs 14, 14'. As a result, both inner bow limbs will move away form outer bow limbs 20, 20'. Tool 150 is then removed by removing tooth member or members 160 from apertures 60, 60' and the bow will be in the cocked state illustrated in FIG. 4.

The function of trigger 80 and its associated mechanism is to catch and hold plate members 54, 56 of cocking mechanism 44 after the cocking mechanism is cocked and to release the plate members and the stored energy in cable 26 and in inner bow limbs 14, 14' upon command. This is accomplished in the following manner. When plate members 54, 56 are rotated slightly more than 180° by tool 150 lips 64 rotate slightly past catch surface 86 of trigger 80. The archer then relaxes his hold on tool 150 to enable plate members 54, 56 to rotate back so that lips 64 engage catch surface 86. Catch surface 86 will then hold the cocking mechanism in its cocked position with lips 64 engaging catch surface 86 since the center of aperture 82 in trigger 80 is located slightly below lips 64 of the winding mechanism when the lips are contacting surface 86.

Arm member 84 of trigger 80 normally extends slightly beyond edge surfaces 53, 53' of support members 46, 48, and an upward movement of arm member 84, caused by catch member 134, will disengage catch surface 86 from lips 64 to allow the cocking mechanism 44, including plate members 54, 56, to rapidly return to its original position. Flat spring 92 mounted on the back of trigger 80 presses against the inside surface 15 of bow limb 14 and insures that the trigger will return to its normal receptive position in order that the trigger and catch surface 86 will engage the next "passing" of lips 64.

Figure 4:
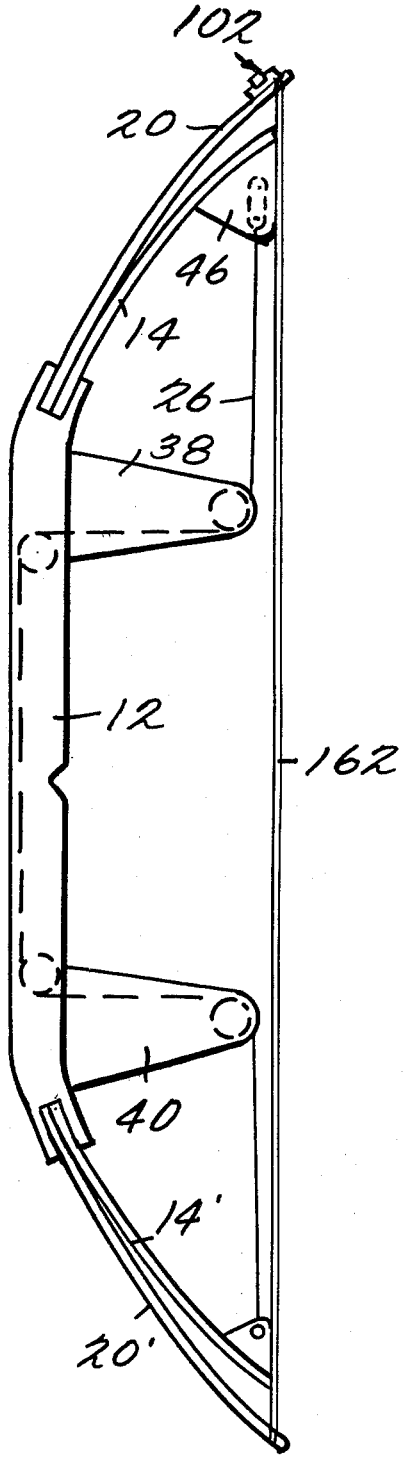
FIG. 4 is a side elevation view of the bow showing the inner bow limbs in cocked position.
Figure 5:
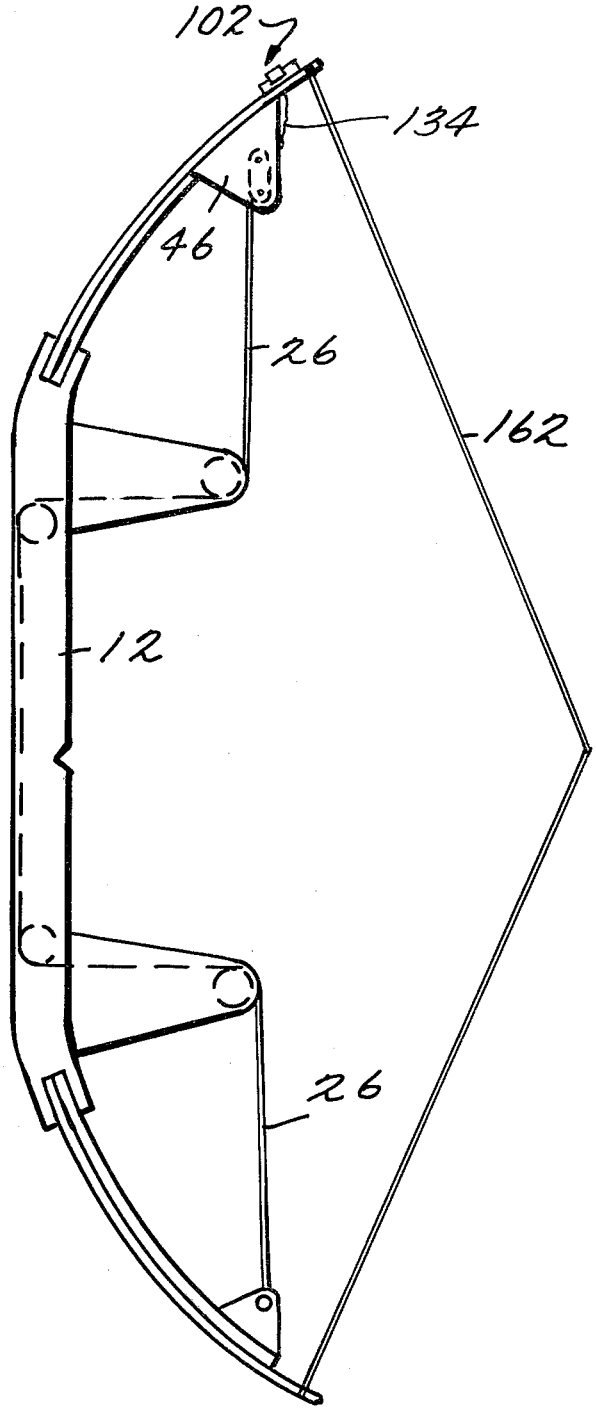
FIG. 5 is a side elevation view of the bow showing the inner limbs in cocked position and showing the outer limbs in a stressed condition prior to release of the arrow.
Figure 7:
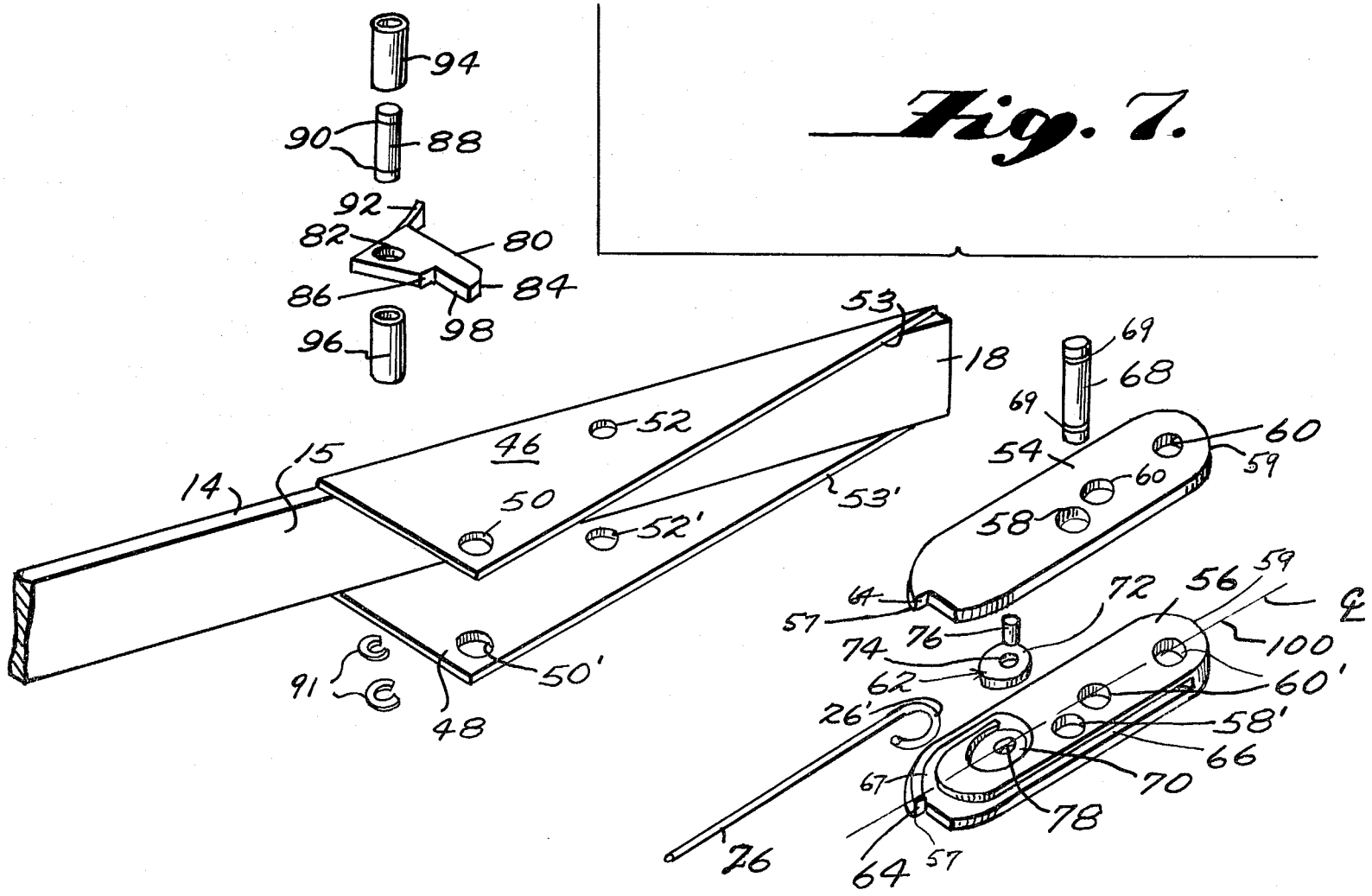
FIG. 7 is an exploded perspective view of the cocking and trigger mechanisms of the bow.

The purpose of third means or release mechanism 102 is to release, via the trigger mechanism, all of the energy stored in inner bow limbs 14, 14' by the cocking mechanism. After the inner bow limbs have been cocked, as shown in FIG. 4, the archer places the arrow in shooting position and draws bow string 162, which is connected between ends 22, 22' of outer bow limbs 20, 20'. This results in moving outer bow limbs 20, 20' against inner bow limbs 14, 14' so that the outer bow limbs "lie down" on the inner bow limbs. Somewhere near the end of the archer's draw of bow string 162, bottom loop 134' of catch 134 passes over arm member 84 of trigger 80 in a downward direction. This has no effect on trigger 80 and lips 64 remain cocked and in contacting relationship with catch surface 86 of the trigger. Simultaneously, spring 142 continues to push against catch 134 and urges the catch into continuously contacting relationship with edge surfaces 53, 53'.

Then the archer releases his grasp on the arrow and on bow string 162. There is instant movement by outer limbs 20, 20' both forwardly and upwardly, and during this movement the bottom 134' of catch 134 moves upwardly and into contact with lower surface 98 of the trigger. The force of the upward movement of catch 134 against lower surface 98 causes trigger 80 to rotate about pin 88 and against the force of spring 92. This results in disengagement of lips 64 from catch surface 86 on the trigger and a release of the energy stored in cable 26 and within inner bow limbs 14, 14' as plate members 54, 56 rapidly rotate 180° around axle 68. If the amount of energy stored in inner bow limbs 14, 14' is significantly greater than in outer limbs 20, 20', the inner set of bow limbs will move much faster than the outer set and will catch up and act with the inner set. This combined thrust will be transferred to the outer bow string 162 and thus to the arrow.

The archer can also adjust the timing of the release of tension within cable 26 and of stress within inner bow limbs 14, 14' by backing off lock nut 148 and by rotating screw 126 by means of the enlarged section or thumb adjustment 132. This will move catch member 134 to the left or the right with respect to mounting member 104, and this will result in the bottom 134' of catch member 134 being located higher or lower, respectively, along edge suraces 53, 53'. This, in turn, will result in bottom 134' of catch member 134 contacting lower surface 98 of the trigger earlier or later, respectively, after the archer has released bow string 162. Thus, the total force imparted to the arrow can be adjusted while enabling the archer to exert the same amount of force each time he draws bow string 162 until outer bow limbs 20, 20' move against inner bow limbs 14 14'.

This invention provides for an improvement in archery bows which provides for the storage of energy in two separate systems of bow limbs in such a manner that the collective energy stored is greater than a normal archer would be able to store in a single set of limbs. The archery bow described herein provides for two sets of bow limbs arranged in such a manner as to allow the archer to realse both sets of limbs simultaneously, thus imparting a greater amount of energy to the arrow. The archery bow of this invention also provides for a single bow string extending between the tips of the outer bow limbs, thus eliminating the obstruction of pulley strings between the nocking point and the bow grip handle, as found in a compound bow. The present invention also provides an archery bow which enables the archer to draw the bow with only a minimum of effort throughout the full draw. This is in direct contrast to the compound bow which is very stiff initially and then becomes easier approximately half way through the draw. The present invention also provides a "stop" feature to prevent the user from over-drawing when the apparatus is at full draw, and the bow of this invention allows the user to adjust the power of the bow to his requirements while requiring only a constant minimum effort on the part of the archer. Of course, the force provided by the bow limbs can vary, but a preferable range for the inner set of bow limbs, 14, 14' would be in the range of 70 to 80 pounds, while the outer set of bow limbs, 20, 20' could be set to around 30 pounds. This would provide an apparatus which would be comparable to a 100 to a 110 pound bow.

The invention in its broader aspects is not limited to the specific details shown and described, and departures may be made from such details without departing from the principles of the invention and without sacrificing its chief advantages.

What is claimed is:

1. An archery bow, comprising:

a bow handle;

a first pair of bow limbs projecting outwardly from opposite ends of said handle to present a first pair of spaced free limb ends;

a second pair of bow limbs projecting outwardly from opposite ends of said handle to present a second pair of spaced free limb ends;

first means in operative relationship with said handle for supporting and guiding a cable in predetermined relationship with said handle;

a cable attached to a first one of said first ends and positioned in supported and guided relationship with respect to said first means;

second means attached to a second one of said first ends and to said cable for enabling tension on said cable and stress on said first pair of limbs to be increased or decreased; and third means attached to one of said second bow limbs in operative relationship with said second means for selectively mechanically interacting with said second means to result in reduction of the tension in said cable and in the stress in said first pair of limbs.

2. An archery bow as in claim 1 wherein said handle defines a hollow opening and wherein said first means supports and guides said cable through said opening.

3. An archery bow as in claim 2 wherein said bow defines an imaginary longitudinal center line plane passing substantially through the center line of the bow and a strung bow string extending between said second pair of spaced free limb ends and wherein said cable passes through at least a portion of said handle opening at locations offset from said imaginary center line plane.

4. An archery bow as in claim 3 wherein said first means include:

first and second brace members projecting from said handle;

a first pulley mounted on said first brace member for receiving said cable;

a second pulley mounted on said second brace member for receiving said cable;

a third pulley positioned within and mounted on said handle for receiving said cable; and a fourth pulley positioned within and mounted on said handle for receiving said cable.

5. An archery bow as in claim 4 wherein said first and second pulleys are positioned on said brace members to enable said cable to be positioned within said imaginary center line plane between said second means and said first pulley and between said second pulley and said first one of said first limb ends.

6. An archery bow as in claim 5 wherein said third and fourth pulleys are positioned within said handle to enable said cable to be positioned outside of said imaginary center line plane between said third and fourth pulleys.

7. An archery bow as in claim 3 wherein said second means include:

first and second support members attached to said second one of said first limb ends, each of said support members defining first and second apertures;

first and second plate members each defining third and fourth apertures;

said second plate member further including means for holding one end of said cable and said second plate member further defining a lip and a recessed groove of a sufficient dimension for receiving said cable within said groove; and an axle extending through and in movable relationship with said third apertures and said axle further extending through and in movable relationship with said first apertures.

8. An archery bow as in claim 7 wherein said second means further include:

a trigger defining a fifth aperture therein and further defining an arm member and a ctach surface for selectively engaging said lip;

a pin extending through and in movable relationship with fifth aperture and said pin further extending through and in movable relationship with said second apertures; and a spring projecting from said trigger and engaging a surface of said bow limb adjacent to said second one of said first limb ends, whereby said arm member is normally held in a predetermined position.

9. An archery bow as in claim 8 wherein said support members each define a first edge surface and wherein said arm member defines a lower surface and is normally positioned to project beyond said first edge surfaces.

10. An archery bow as in claim 9 wherein each of said plate members is elongated in shape with a longer length dimension between ends than width dimension, said plate members each defining an imaginary lengthwise center line and the centers of each of said third apertures being positioned at a location offset from said center line but substantially equidistant from the lengthwise ends of each plate.

11. An archery bow as in claim 10 wherein the center of said fifth aperture is positioned below said lip when said lip and said catch surface are in contacting relationship with each other.

12. An archery bow as in claim 11 further including first and second sleeves positioned on said pin and between said support members for maintaining said trigger in predetermined position on said pin.

13. An archery bow as in claim 12 wherein said second plate member further defines a recessed cavity in communication with said groove and wherein said second means further include: a disc defining an eccentrically positioned aperture; and a spindle extending through said last-mentioned aperture and positioned in fixed relationship with said support members; and said cable being attached to said disc.

14. An archery bow as in claim 9 wherein said third means include:

a mounting member attached to and adjacent an end of one of said second bow limbs;

a catch member supported by said mounting member and positioned to engage said lower surface of said arm member when said first and second pair of bow limbs are placed under predetermined amounts of stress; and second spring means in operative relationship with said mounting member and with said catch member for contacting said catch member and for urging said catch member into contacting relationship with said first edge surfaces of said support members.

15. An archery bow as in claim 14 further including means in operative relationship with said mounting member and with said catch member for adjusting the position of said catch member with respect to said mounting member.

16. An archery bow as in claim 14 wherein said mounting member defines a planar base and two flanges projecting upwardly from said base at substantially right angles thereto, each of said flanges defining a non-threaded aperture;

a cube-like member having two opposed wall sections each defining a non-threaded aperture therein and having two additional opposed wall sections each defining a threaded aperture therein;

a screw defining first and second unthreaded ends and a center threaded section, and further defining an enlarged section adjacent said first end for enabling manual turning of said screw;

said catch member defining first and second ends rotatably held within said non-threaded apertures of said cube-like member;

said center threaded section of said screw threadedly engaging said threaded aperture of said cube-like member, and said unthreaded ends of said screw positioned within said non-threaded apertures of said flanges; and a lock nut threaded onto said center threaded section of said screw for holding said screw in predetermined fixed position with respect to said mounting member 17. An archery bow as in claim 16 wherein said cube-like member defines additional apertures adjacent to said non-threaded apertures of said cube-like member and further including spring supports projecting from said cube-like member adjacent to said additional apertures, said second spring means supported by said spring supports, and ends of said second spring means being anchored by passing through said additional apertures.

18. An archery bow as in claim 16 further including a bow string extending between said second pair of limb ends.

19. An archery bow as in claim 7 in combination with a tool for moving said plate members, said cable and said first pair of bow limbs to a cocked position wherein the tension in said cable and the stress in said first pair of bow limbs is increased, said tool comprising:

a tool handle;

a body section extending from said tool handle;

an angled member extending from said body section;

an end section extending from said angled member and in substantially parallel relationship with respect to said body section; and at least one tooth member projecting at substantially a right angle from said end section, said tooth member being substantially circular in cross-section and having an outside diameter slightly less than the inside diameter of said fourth aperture.

* * * * *